US007731875B2

(12) United States Patent
Glass et al.

(10) Patent No.: US 7,731,875 B2
(45) Date of Patent: Jun. 8, 2010

(54) SACRIFICIAL ANODES IN CONCRETE PATCH REPAIR

(76) Inventors: Gareth Kevin Glass, 3 Hillside, Lichfield (GB) WS14 9DQ; Nigel Davison, 3 Chapmans Croft, Coton-in-the-elms, Swadlincote (GB) DE12 8DG; Adrian Charles Roberts, 11 Calvert Close, Chilwell, Nottingham (GB) NG9 5HG ( * ) Notice: Subject to any disclaimer, the term of this patent is extended or adjusted under 35 U.S.C. 154(b) by 0 days.

(21) Appl. No.: 12/253,995

(22) Filed: Oct. 19, 2008

(65) Prior Publication Data

US 2009/0236764 A1 Sep. 24, 2009

Related U.S. Application Data

(63) Continuation-in-part of application No. 12/067,632, filed on Mar. 20, 2008.

(51) Int. Cl.
*B29C 73/00* (2006.01)

(52) U.S. Cl. ..... 264/36.18; 264/36.2; 205/734

(58) Field of Classification Search ..... 264/36.2, 264/36.18; 205/730, 734, 735; 204/196.01, 204/196.3, 196.36
See application file for complete search history.

(56) References Cited

U.S. PATENT DOCUMENTS 5,292,411 A * 3/1994 Bartholomew et al. ..... 205/731
6,022,469 A 2/2000 Page
6,193,857 B1 2/2001 Davison et al.
6,217,742 B1 4/2001 Bennett
6,303,017 B1 10/2001 Page et al.
2004/0238376 A1* 12/2004 Whitmore ..... 205/734

OTHER PUBLICATIONS

Davison, N., et al., "Principles and applications of galvanic repair . . . ", in Proceedings of the 7th Int. Conf. on Concrete in Hot and Aggressive Env., 2003, vol. 2, 747.
ACI Committee E 706, Installation of Embedded Galvanic Anodes, ACI Repair Application Procedure 8, American Concrete Institute 2005.
Fosroc Galvashield CC datasheet.
Fosroc Glavashield XP datasheet.
Vector/Sika Galvashield CC datasheet.
Vector/Sika Galvashield XP datasheet.
Euclid Sentinel datasheet.
Page and Sergi, Journal of Materials in Civil Engineering, vol. 12 No. 1, pp. 8-15, 2000.

* cited by examiner

*Primary Examiner*—Joseph S Del Sole
*Assistant Examiner*—James Sanders

(57) ABSTRACT

High performance proprietary cementitious concretes or mortars developed for use as patch repair materials for corrosion damaged concrete often have high resistivities that inhibit the performance of sacrificial anodes located within the patch repair areas. A method of repair is disclosed which comprises removing the corrosion damaged concrete to form a cavity to receive a concrete repair material and forming within this cavity a smaller distinct cavity for assembling a sacrificial anode assembly and placing within this second cavity a pliable viscous ionically conductive backfill and a sacrificial anode and an activating agent to form a sacrificial anode assembly and connecting the anode to the steel and covering the anode and the backfill in the second cavity with a repair material to restore the profile of the concrete structure. In this arrangement a high resistivity repair material promotes the flow of protection current to steel in adjacent contaminated concrete that is at risk of corrosion.

19 Claims, 1 Drawing Sheet

SACRIFICIAL ANODES IN CONCRETE PATCH REPAIR

This application is a continuation in part application from application Ser. No. 12/067,632 filed Mar. 20, 2008.

TECHNICAL FIELD

This invention is related to the galvanic protection of steel in concrete and in particular to the use of sacrificial anodes to protect steel reinforcement in concrete construction at locations where the reinforced concrete is subject to patch repair as the result of corrosion induced deterioration.

BACKGROUND

Steel reinforced concrete structures suffer corrosion induced damage as the result of carbonation or chloride contamination of the concrete. The steel reinforcement corrodes to produce products that occupy a larger volume than the steel from which the products are derived. As a result expansion occurs around reinforcing steel bars. This causes cracking and delamination of the concrete cover to the steel. Repairs involve removing this patch of damaged concrete. It is good practice to remove the concrete (break it out) behind the corroding steel and to remove as much of the contaminated concrete as possible. The concrete profile is then restored with a compatible cementitious repair concrete or mortar. The concrete then consists of the parent concrete (remaining original concrete) and the repair material at the patch. Previous research effort has resulted in the generation of a number of competing high performance proprietary cementitious concretes or mortars for use as concrete repair materials.

The parent concrete adjacent to the repair area is likely to contain some aggressive contaminants as the result of its exposure to the environment that caused the damage at the patch. Sacrificial anode assemblies may be tied to the steel to provide galvanic protection to the steel that is in the adjacent parent concrete prior to covering the steel and restoring the concrete profile with the repair material. One example is shown in Repair Application Procedure number 8 published by the American Concrete Institute (ACI). The anode assembly typically comprises a pre-assembled anode and backfill wherein the backfill contains an activating agent and the assembly forms a rigid assembly that can be tied to the steel exposed in the cavity formed by the removal of the damaged concrete. One problem with this arrangement is that the current delivered to the steel in the adjacent concrete depends on the resistivity of the concrete repair material. Repair materials with a high resistance to the ingress of contaminants also tend to have a high electrical resistivity, but a high electrical resistivity of the repair material reduces the current output of the anode and therefore the protection current delivered to the steel in the parent concrete adjacent to the repair. A proposed solution to this problem is to use a low resistivity bridging mortar to connect the preformed anode assembly tied to the steel to the original (parent) concrete prior to installing the concrete repair material. However this compromises the quality of the repair material and increases the number of interfaces between the sacrificial anode and the parent concrete where further problems may occur.

SUMMARY OF THE INVENTION

A solution to this problem is to form another cavity (a second cavity) within the cavity prepared to receive the concrete repair material (the first cavity) wherein the second cavity is adapted for the assembly of a sacrificial anode and backfill. An example of the second cavity is a hole cored or drilled into the parent concrete exposed in the first cavity. The second cavity has a substantially smaller volume than the first cavity. The sacrificial anode and backfill is then assembled within this second cavity and connected to the steel with a suitable connection, examples of which are known in the art. The sacrificial anode assembly includes a sacrificial anode, a pliable viscous backfill, an activating agent and a connecting conductor. The conductor is used to electronically connect the sacrificial anode to the steel and hence allow electrons to flow from the anode to the steel. The anode may easily be connected to the exposed steel in the first cavity to keep this connection detail simple. The pliable viscous backfill is preferably a putty and is preferably stored in a cartridge and is preferably dispensed from the cartridge into the second cavity. The backfill preferably has a shelf life of at least 1 month wherein it can be assembled and stored in a cartridge ready for use. The backfill preferably hardens slowly to form a weak porous material that can accommodate products that arise from the sacrificial anode reaction commonly termed sacrificial anode dissolution. These products may be expansive and the backfill is preferably weak and has void space. The backfill connects to the sacrificial anode in a way that allows the products of the sacrificial anode reaction to enter the backfill. The backfill is preferably in direct contact with the sacrificial anode. The backfill is used to ionically connect the anode to the parent concrete and hence allow ionic current to flow from the anode through the parent concrete to the steel in the parent concrete. The activating agent may be included with the anode or with the backfill. The sacrificial anode assembly is covered by the concrete repair material that is used to fill the first cavity arising from corrosion damage and restore the concrete profile. The sacrificial anode and the relatively weak backfill are then protected from the weathering environment by this concrete repair material. No further protection is required. The protection current flows as ions from the sacrificial anode through the backfill into the parent concrete to the steel and returns as electrons through the steel and conductor to the sacrificial anode. The ionic current needs to cross no more than 2 interfaces in the process. The repair material preferably has a higher resistivity than the parent concrete in the vicinity of the anode to promote the flow of current to the steel in the parent concrete. It is preferable that the resistivity of the concrete repair material is at least double that of the parent concrete and more preferably at least 3 times that of the parent concrete in the vicinity of the anode.

ADVANTAGEOUS EFFECTS

This arrangement promotes current flow to the steel in the parent concrete without restricting the choice of concrete repair material to a material with a resistivity that is similar to or less than the parent concrete. High resistivity concrete repair materials may be used to cover the sacrificial anode and backfill and the use of high resistivity repair materials promotes the flow of current to steel in the original parent concrete. Examples include materials containing silica fume that are applied by a dry or wet spray process. The quality of the concrete repair need not be compromised by a need for the repair material to conduct current. The anode is easily connected to the exposed steel in the repair area and isolation of the anode assembly from the weathering environment is achieved by the patch repair material.

DETAILED DESCRIPTION

In the first stage of a repair process, cracked and delaminating concrete is removed and a cavity is prepared to receive a concrete repair material. This is referred to as the first cavity. Within this cavity another smaller cavity is formed for the purposes of assembling an anode and backfill. This is distinct from the first cavity and is referred to as the second cavity. This second cavity will preferably be a drilled or cored hole. It will have a small volume relative to the first cavity. A typical second cavity will be no more than 50 mm in diameter and 200 mm in length. Its volume will typically be at least an order of magnitude less than the first cavity.

A sacrificial anode assembly is then assembled within the second cavity. The backfill is a pliable, viscous material into which the anode may be inserted. It is ionically conductive. It is preferably a putty. An example is lime putty. It preferably hardens slowly with time to form a weak porous material with a compressive strength of less than 5 $N/mm^2$ and more preferably less than 1 $N/mm^2$ to accommodate any products from the dissolution of the sacrificial anode. It preferably has a conductivity of less than 20 kOhms-cm and more preferably less than 2 kOhms-cm to promote the flow of current from the sacrificial anode to the surrounding concrete.

In an example of the anode installation process a backfill is placed in the second cavity and an anode is inserted into the backfill. It is preferable to partially fill the second cavity with the backfill and then insert the anode into the backfill. The sacrificial anode is a metal less noble than steel, examples being zinc, aluminium or magnesium or alloys thereof. Zinc is currently preferred for use in cavities in concrete. The anode shape is adapted for insertion into the backfill in the cavity. Examples include a cylinder, tube or bar. The metal anode may be porous. The anode makes contact with the backfill and the anode reaction includes the dissolution of the sacrificial metal element into the backfill.

Included within the assembly is an activating agent to maintain sacrificial anode activity. This may for example be included within the anode or added to the backfill. Examples of activating agents, known in the art are hydroxide and halide ions.

A conductor is used to electronically connect the sacrificial anode to the steel and hence allow electrons to flow from the anode to the steel. An example of a conductor is a wire. A steel wire is suitable. One end of the wire may be connected to the anode by casting the anode around the wire. The other end of the wire may be connected to the steel by clamping it to the steel that was exposed by the removal of the corrosion damaged concrete. Other examples of this connection detail are known in the art. For example, monitoring may be facilitated by running a conductor connected to the steel and another conductor connected to the anode to monitoring equipment which connects the steel to the anode.

The backfill will preferably have a resistivity that is less than the parent concrete or the concrete repair material to promote the flow of ionic current off the anode and into the parent concrete. The corrosion risk in concrete increases as the concrete resistivity falls below 20 kOhm-cm. It is therefore preferable that the backfill has a resistivity that is less than this and more preferably less than 2 kOhm-cm.

The backfill preferably accommodates any expansive products arising from the dissolution of the sacrificial metal element. The backfill should therefore have a low compressive strength compared to the tensile strength of the surrounding concrete. It is therefore preferable that the ultimate compressive strength of the backfill does not exceed 5 $N/mm^2$ and more preferably does not exceed 1 $N/mm^2$.

To accommodate the products of the sacrificial metal reaction the backfill needs to have a fluid filled void space. This will be at least partially filled with electrolyte to facilitate ionic current flow from the sacrificial anode to the parent concrete. The void space may result from shrinkage of the backfill as it hardens slowly. It is preferable that the backfill may be compressed to less than 50% and more preferably less than 80% of its original volume.

BRIEF DESCRIPTION OF THE DRAWING

This invention will now be described further with reference by way of example to the drawing in which.

EXAMPLE

Figure 1:
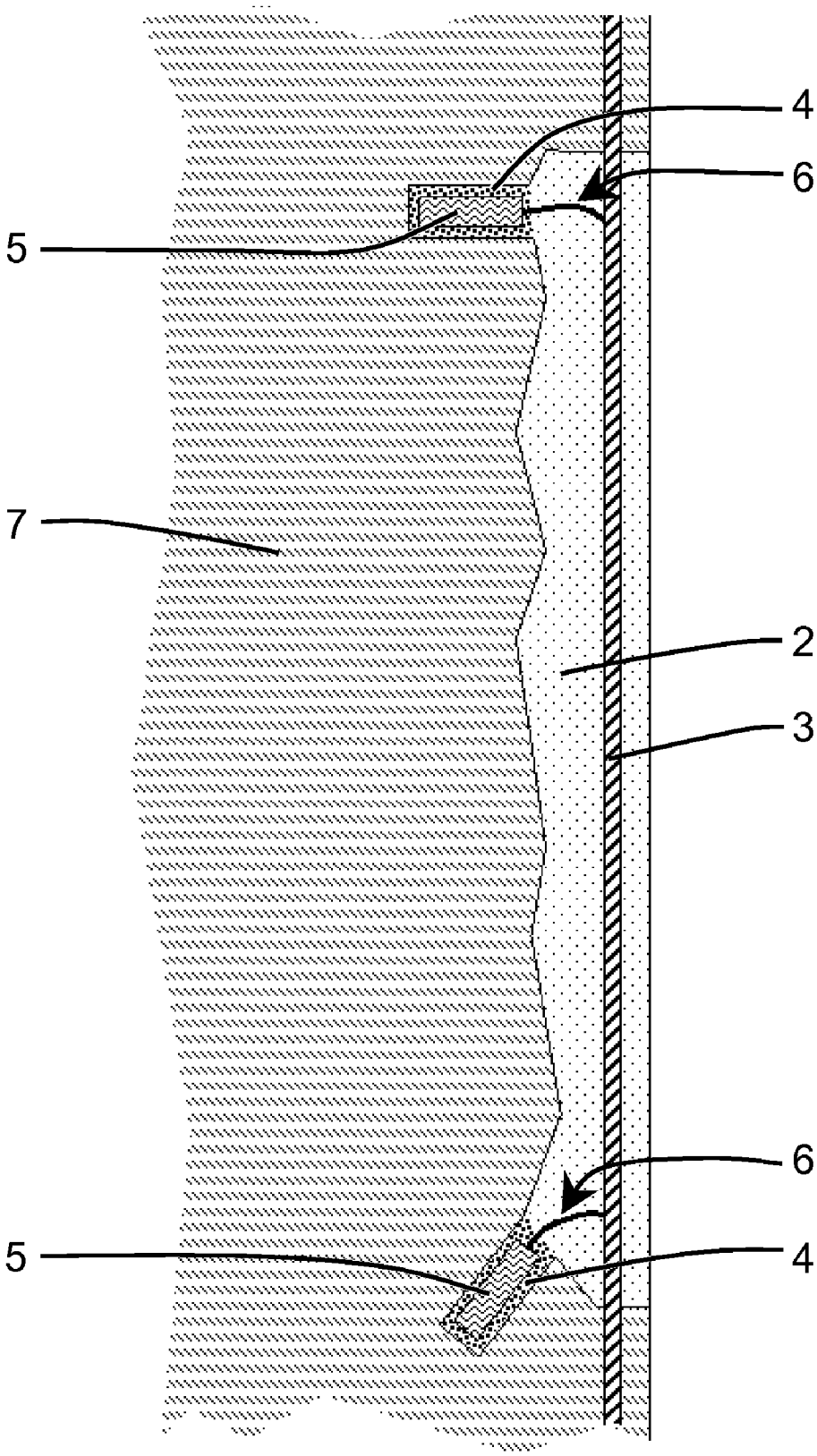
FIG. 1 shows a section through a reinforced concrete element that includes a repaired area with sacrificial anodes in two cavities formed within the repaired area.

Referring to FIG. 1, a reinforced concrete element has been subject to a repair process wherein a cavity [2] is formed by the removal of damaged concrete to receive a concrete repair material. At least one steel bar [3] is exposed at the cavity. Within the cavity holes [4] are formed in which to assemble a sacrificial anode assembly. These holes may be formed by drilling or coring. They are located close to the periphery of the repair area to promote current distribution to the steel adjacent to the repair area. The holes formed for the sacrificial anode assembly are substantially smaller than the cavity formed to receive the concrete repair material. A backfill is placed within the holes [4] and sacrificial anodes [5] are inserted into the backfill. A conductor [6] connects the sacrificial anode to the exposed steel bar to allow current to flow by means of electron conduction. The backfill connects the sacrificial metal element to the original or parent concrete [7] to allow ionic current to flow to the steel in the parent concrete. The distribution of current flow to the steel in the parent concrete is not as sensitive to the properties of the repair material as would be the case with a preformed anode assembly embedded within the repair material. Indeed in this arrangement a high resistivity repair material would promote the flow of current to the steel in the adjacent parent concrete.

The invention claimed is:

1. A method of repairing a corrosion damaged concrete structure which comprises removing the corrosion damaged concrete to form a first cavity to receive a concrete repair material and exposing at least one steel bar within the first cavity and forming within the concrete a smaller distinct second cavity that opens into the first cavity for assembling a sacrificial anode assembly and placing within the second cavity a pliable viscous ionically conductive backfill and a sacrificial anode and an activating agent to form a sacrificial anode assembly and connecting the sacrificial anode to the steel bar exposed in the first cavity with an electron conducting conductor that runs from the sacrificial anode to the exposed steel bar and covering the anode and the backfill in the second cavity with a repair material to restore the profile of the concrete structure.

2. A method as claimed in claim 1 wherein the resistivity of the repair material is greater than the resistivity of the concrete surrounding the sacrificial anode assembly.

3. A method as claimed in claim 2 wherein the resistivity of the repair material is at least double the resistivity of the concrete surrounding the sacrificial anode assembly.

4. A method as claimed in claim 3 wherein the resistivity of the repair material is at least 3 times the resistivity of the concrete surrounding the sacrificial anode assembly.

5. A method as claimed in claim 1 wherein the backfill is dispensed from a cartridge into the second cavity.

6. A method as claimed in claim 5 wherein the backfill is stored ready for use in the cartridge and has a shelf life of at least 1 month.

7. A method as claimed in claim 1 wherein the backfill is a putty.

8. A method as claimed in claim 7 wherein the backfill hardens and the compressive strength of the backfill does not exceed 5 $N/mm^2$.

9. A method as claimed in claim 8 wherein the compressive strength of the backfill does not exceed $1N/mm^2$.

10. A method as claimed in claim 1 wherein the backfill hardens and the resistivity of the backfill does not exceed 20 kOhm-cm.

11. A method as claimed in claim 10 wherein the resistivity of the backfill does not exceed 2 kOhm-cm.

12. A method as claimed in claim 1 wherein the second cavity has a volume that is at least one order of magnitude less than the first cavity.

13. A method as claimed in claim 5 wherein the anode is inserted into the backfill.

14. A method as claimed in claim 1 wherein the second cavity is formed by at least one of coring, drilling.

15. A method as claimed in claim 5 wherein the backfill is a putty.

16. A method as claimed in claim 1 wherein the backfill accommodates expansive products arising from the dissolution of the sacrificial metal element.

17. A method as claimed in claim 3 wherein the backfill accommodates expansive products arising from the dissolution of the sacrificial metal element.

18. A method as claimed in claim 10 wherein the backfill accommodates expansive products arising from the dissolution of the sacrificial metal element.

19. A method as claimed in claim 7 wherein the backfill accommodates expansive products arising from the dissolution of the sacrificial metal element.

* * * * *